US009862589B2

(12) United States Patent
Cummer et al.

(10) Patent No.: US 9,862,589 B2
(45) Date of Patent: Jan. 9, 2018

(54) CHILLED BEVERAGE DISPENSER

(71) Applicant: STARBUCKS CORPORATION, Seattle, WA (US)

(72) Inventors: Michael Cummer, Seattle, WA (US); Izaak Matthew Koller, Seattle, WA (US); Alexander Clinton Schacht, Seattle, WA (US)

(73) Assignee: STARBUCKS CORPORATION, Seattle, WA (US)

( * ) Notice: Subject to any disclaimer, the term of this patent is extended or adjusted under 35 U.S.C. 154(b) by 0 days.

(21) Appl. No.: 15/169,323

(22) Filed: May 31, 2016

(65) Prior Publication Data

US 2017/0341921 A1 Nov. 30, 2017

(51) Int. Cl.
*B67D 1/08* (2006.01)
*B67D 1/14* (2006.01)

(52) U.S. Cl.
CPC ..... *B67D 1/0884* (2013.01); *B67D 1/0857* (2013.01); *B67D 1/0882* (2013.01); *B67D 1/1405* (2013.01); *B67D 2001/1483* (2013.01)

(58) Field of Classification Search
CPC .. B67D 1/0884; B67D 1/0857; B67D 1/0882; B67D 1/1405; B67D 2001/1483
USPC ..... 222/519, 538, 146.6, 129.1
See application file for complete search history.

(56) References Cited

U.S. PATENT DOCUMENTS 2,083,776 A * 6/1937 Ferguson ..... B67D 1/0829 217/114
3,039,656 A * 6/1962 Wentz ..... B67D 1/1466 222/173
4,094,445 A 6/1978 Bevan
4,610,375 A 9/1986 Germi et al.
4,979,641 A 12/1990 Turner
5,873,259 A 2/1999 Spillman
6,360,556 B1 3/2002 Gagliano
6,401,989 B1 * 6/2002 Grittmann ..... B67D 3/043 222/518
6,439,434 B2 8/2002 Johansson et al.
6,460,568 B1 10/2002 Goodwin
(Continued)

FOREIGN PATENT DOCUMENTS

WO WO1999/024351 A1 5/1999
WO WO2005/054763 A1 6/2005
(Continued)

OTHER PUBLICATIONS

Six Simple Machines webpage, The Juggler café milk tap system, Hands-free milk dispensing for hands-on baristas, www.sixsimplemachines.com.au, in 21 pages (accessed Nov. 1, 2016).
(Continued)

*Primary Examiner* — Donnell Long
(74) *Attorney, Agent, or Firm* — Knobbe, Martens, Olson & Bear LLP

(57) ABSTRACT

Various apparatus and systems for chilled beverage dispensing are disclosed. The beverage dispenser can be configured such that any surface that the dispensed beverage is in contact with during the dispensing process is refrigerated to the appropriate temperature. In some examples, the beverage dispenser can extend from and retract into a refrigerated source. In some examples, the beverage dispenser can be built into a refrigeration system.

22 Claims, 11 Drawing Sheets

(56) References Cited

U.S. PATENT DOCUMENTS

| | | | | |
|---|---|---|---|---|
| 7,044,335 | B2 * | 5/2006 | Aguirre | B67D 1/0406 222/129.1 |
| 7,584,873 | B2 * | 9/2009 | Grittmann | B67D 1/0418 222/394 |
| 7,661,556 | B2 | 2/2010 | van der Klaauw et al. | |
| 8,141,747 | B2 | 3/2012 | Kim et al. | |
| 8,313,007 | B2 | 11/2012 | Kpabar | |
| 8,701,428 | B2 | 4/2014 | Lee et al. | |
| 9,027,792 | B2 | 5/2015 | Watts | |
| 9,198,458 | B2 | 12/2015 | Bertone | |
| 2007/0084883 | A1 * | 4/2007 | Magermans | B67D 1/0412 222/400.7 |
| 2008/0272156 | A1 * | 11/2008 | Dyson | A47J 31/4482 222/504 |
| 2010/0181341 | A1 | 7/2010 | Robinson | |
| 2010/0294799 | A1 * | 11/2010 | Kolon | B65D 7/045 222/23 |
| 2011/0023511 | A1 * | 2/2011 | Lee | B67D 1/0857 62/178 |
| 2014/0137982 | A1 | 5/2014 | Nicholls et al. | |
| 2014/0263433 | A1 | 9/2014 | Merrifield et al. | |
| 2014/0319175 | A1 | 10/2014 | Tobler | |
| 2014/0361043 | A1 | 12/2014 | Jablonski et al. | |
| 2014/0373561 | A1 | 12/2014 | Alt et al. | |
| 2015/0108169 | A1 * | 4/2015 | Bishel | B67D 3/0051 222/166 |
| 2016/0347598 | A1 * | 12/2016 | Gannon | B67D 1/0857 |

FOREIGN PATENT DOCUMENTS

| | | | |
|---|---|---|---|
| WO | WO2006/103566 | A2 | 10/2006 |
| WO | WO2008/125113 | A2 | 10/2008 |
| WO | WO2008/125932 | A2 | 10/2008 |
| WO | WO2010/112292 | A2 | 10/2010 |
| WO | WO2010/134801 | A1 | 11/2010 |
| WO | WO2014/024053 | A1 | 2/2014 |
| WO | WO2014/141041 | A1 | 9/2014 |
| WO | WO2015/001011 | A1 | 1/2015 |
| WO | WO2015/022692 | A2 | 2/2015 |

OTHER PUBLICATIONS

Six Simple Machines, the juggler café milk tap system, Installation Overview, General Installation Guidelines and checklist, www.thejuggler.com.au, in 3 pages (accessed Dec. 11, 2016).

Six Simple Machines, the juggler café milk tap system, Installation Guide, www.thejuggler.com.au, in 13 pages (accessed Dec. 11, 2016).

PCT Search Report and Written Opinion in PCT Application No. PCT/US17/34057 dated Jun. 28, 2017 in 11 pages.

* cited by examiner

CHILLED BEVERAGE DISPENSER

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

FIELD

The present disclosure relates generally to beverage dispensing systems, and specifically to tap-based beverage dispensing systems.

DESCRIPTION OF CERTAIN RELATED ART

In beverage dispensing technology, it can be important for both sanitary and regulatory reasons to maintain low temperatures in the product being dispensed. Different products have different regulatory standards, for example, NSF 18 is applicable to beer technology, while NSF 20 is applicable to milk dispensing.

Some systems for maintaining the low temperatures in the product being dispensed can include a cold block positioned within a tower, a tap extending from the tower and an internal valve. The internal valve is configured such that beverage which is held within the system is not inside the tap but rather is entirely within the tower and any beverage within the tap will drain out immediately after the tap is closed. The cold block keeps the beverage cold as the beverage stops at the valve seat positioned near the cold block.

BRIEF DESCRIPTION OF THE FIGURES

Various embodiments are depicted in the accompanying drawings for illustrative purposes. The drawings should not be interpreted as limiting the scope of this disclosure. Various features of different disclosed embodiments can be combined to form additional embodiments, which are part of this disclosure. Any one feature or any combination of features, of any embodiment can be included in any other embodiment.

DETAILED DESCRIPTION OF CERTAIN EMBODIMENTS

In certain applications, a beverage dispenser can seek to maintain a contained beverage at low temperatures for both sanitary and regulatory reasons. However, prior systems can be bulky and can limit the configuration and aesthetics of the beverage dispenser. In addition, prior systems can allow residual portions of beverage to accumulate in unrefrigerated portions of the dispensing system. This can allow the accumulated unrefrigerated portions to spoil and come in contact with the refrigerated beverage when it is dispensed which can contaminate the beverage as a whole with bacteria or affect the taste of the beverage as a whole.

Accordingly, in certain embodiments disclosed herein, a beverage dispenser advantageously is refrigerated such that any surface that the dispensed beverage is in contact with during the dispensing process is kept in a refrigerated environment at the appropriate temperature in view of sanitary and/or regulatory concerns. In certain examples of the disclosed beverage dispenser, any residual amounts of beverage remaining in any portion of the beverage dispenser will be maintained at the appropriate temperature in the refrigerated environment to prevent and/or inhibit spoiling. As well, the design of the disclosed beverage dispenser can in certain embodiments be configured such that it does not require bulky components that can affect the aesthetic appeal of the beverage dispenser.

Retractable Beverage Dispenser System

Figure 1:
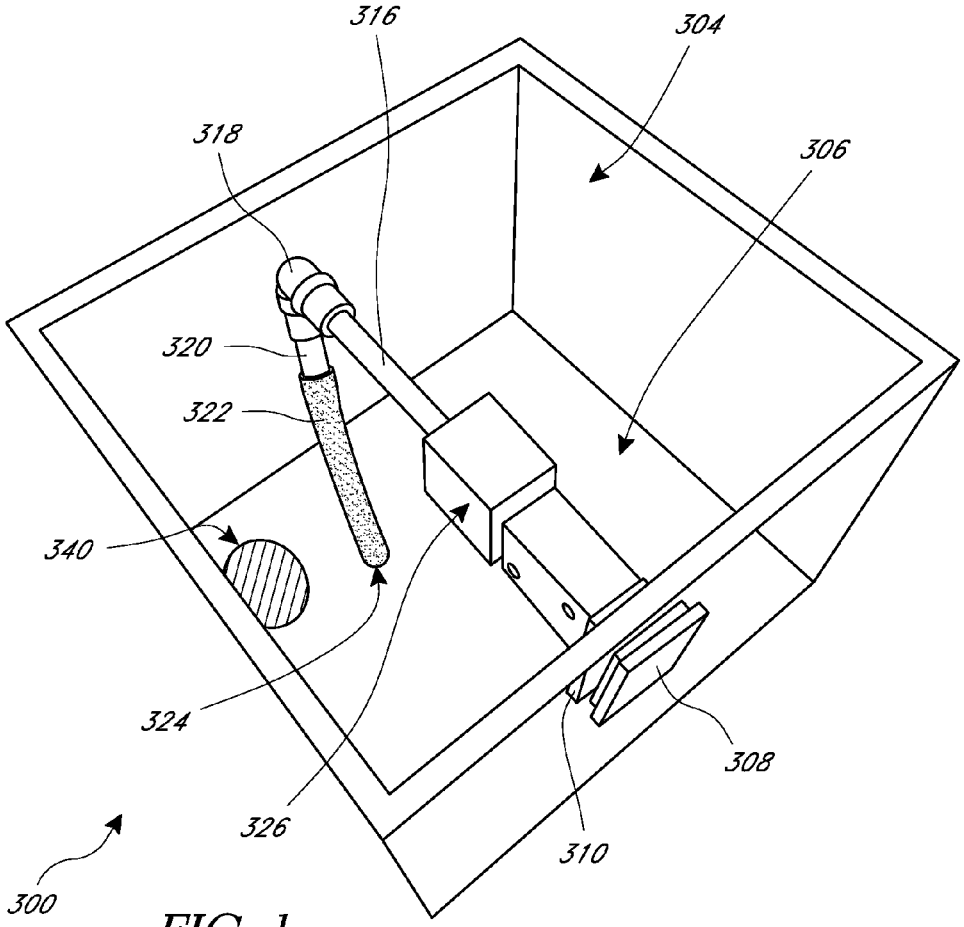
FIG. 1 is a top view of an embodiment a beverage dispenser system including a retractable tap in a retracted position
Figure 2:
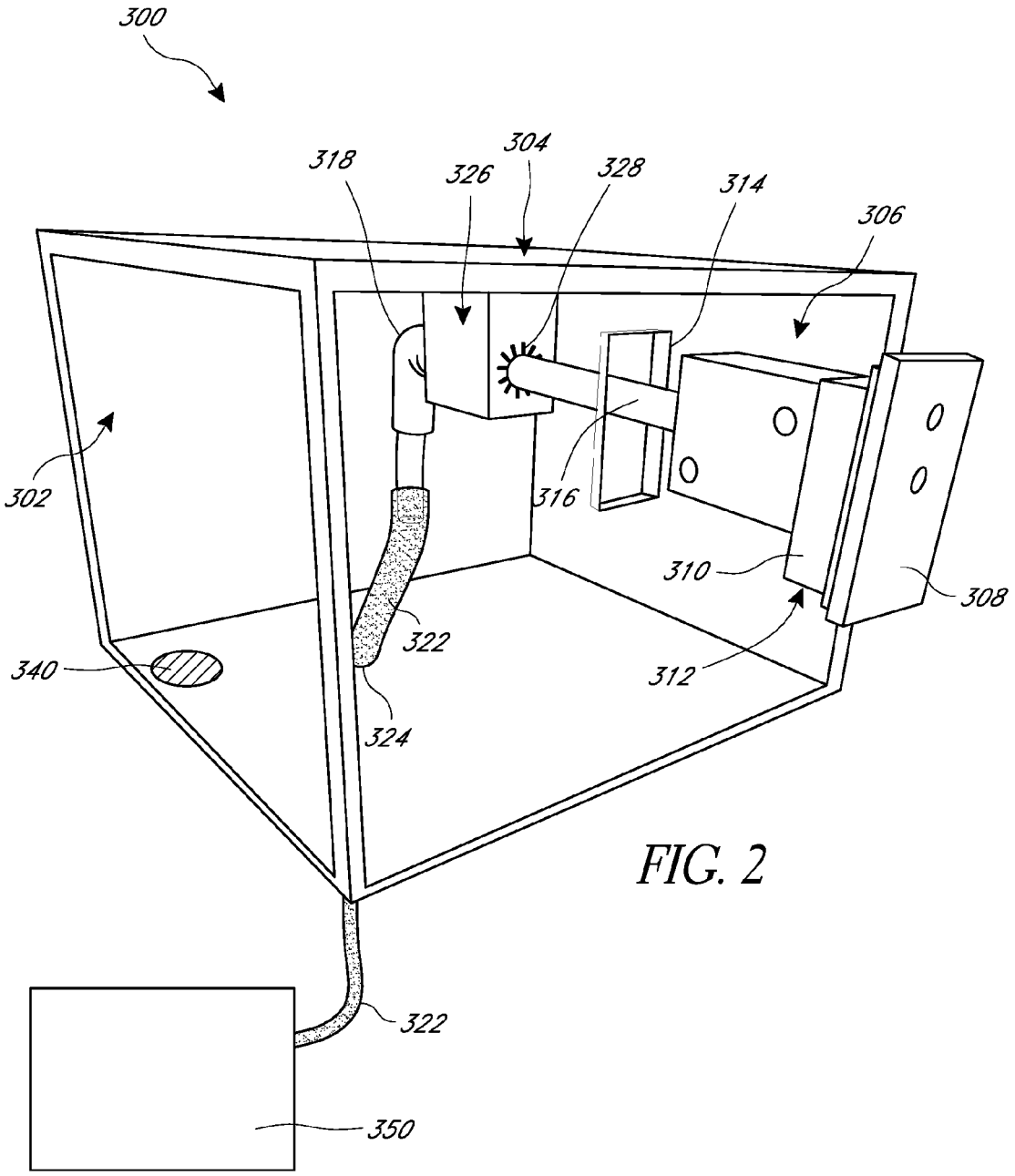
FIG. 2 illustrates a front-perspective view of the beverage dispenser system of FIG. 1 with the tap in an extended position.

FIGS. 1 and 2 illustrate an example embodiment of a beverage dispenser system 300 with a retractable dispenser 306. FIG. 1 illustrates the beverage dispenser system 300 the dispenser 306 is shown in a retracted position inside a housing 302. FIG. 2 illustrates the beverage dispenser system 300 in an extended position in which the dispenser 306 extends from the housing 302 to dispense a liquid (e.g. milk). As will be discussed in more detail below, in certain embodiments, the beverage dispensing system 300 can facilitate maintaining the dispensed beverage at low temperatures including any residual amounts of beverage that has collected after a dispensing operation. As described below, the housing 302 can include a roof 304, which is omitted from FIG. 1 to aid the illustration but is shown in FIG. 2.

In order to maintain the temperature of the beverage, the beverage dispensing system 300 can include the housing 302, which can provide an enclosed or substantially enclosed refrigerated environment for components positioned within the housing 302. In some examples, the components positioned within the housing 302 can include all of the components of the beverage dispensing system 300 that come in contact with the beverage during a dispensing operation.

As illustrated in FIGS. 1 and 2, the housing 302 can be in the form of a cube. In other embodiments, the housing 302 can have other shapes such as a cylinder, pyramid, etc. The housing 302 can also be part of and/or share sides or walls a larger housing or system.

As noted above, in certain embodiments the housing 302 can maintain all components and/or surfaces of such components that come in contact with the dispensed beverage system in a refrigerated environment. A "refrigerated environment" is intended to be a broad term that in addition to its ordinary meaning includes a cooled environment in light of sanitary and/or regulatory concerns of the dispensed beverage. In certain embodiments, the refrigerated environment can be maintained at a temperature of between about 35° F. and about 40° F. and/or a different temperature range depending upon the beverage and/or desired dispensing temperature. In some examples, the housing 302 can be composed of a structural and/or insulation materials such as various combinations, of plastics, metals, foams, fiberglass, polyurethane insulation, air gaps, etc. so as to provide sufficient insulation to maintain the cooling temperature within the housing 302. The temperature within the housing 302 can be generated and/or maintained in a number of ways. In some examples, the housing 302 can be disposed over a cooling port 340 that provides cool air within the housing 302 and maintains the temperature within the housing 302. The cool air can be cooled through a various cooling and/or refrigeration systems. In certain embodiments, the cooling within the housing 302 can be provided by circulating a coolant through the housing 302 and/or using such a coolant in combination a cooling part 340.

With continued reference to FIGS. 1 and 2, the housing 302 can include an opening 314 that can allow certain components of the beverage dispensing system 300 such as the dispenser 306 to extend from the housing 302 and dispense the beverage. As will be discussed in more detail below, the dispenser 306 of the beverage dispensing system 300 can include a tab 308 that can form a seal that prevents cold air from escaping the housing 302 when the dispenser 306 is in a retracted position.

In some examples, the internal components of the system for beverage dispensing 300 that can be extended through the opening 314 include the dispenser 306 that is configured to extend from the housing 302 to dispense a beverage. In some embodiments, the dispenser 306 can be fluidly connected to a refrigerated beverage reservoir through one or more channels and/or tubes. As illustrated in FIG. 2, in the illustrated example embodiment, the dispenser 306 is fluidly connected to a refrigerated beverage reservoir 350 through a tube 316, an angled connector 318 and flexible tube 322. In the illustrated example, the flexible tube 322 is connected to the angled connector 318, which is then in turn connected to the tube 316. In modified embodiments, additional and/or modified configurations of the flow passages, tubes, pipes and/or channels can be used to fluidly connect the dispenser 306 to the refrigerated beverage reservoir 350.

Figure 2A:
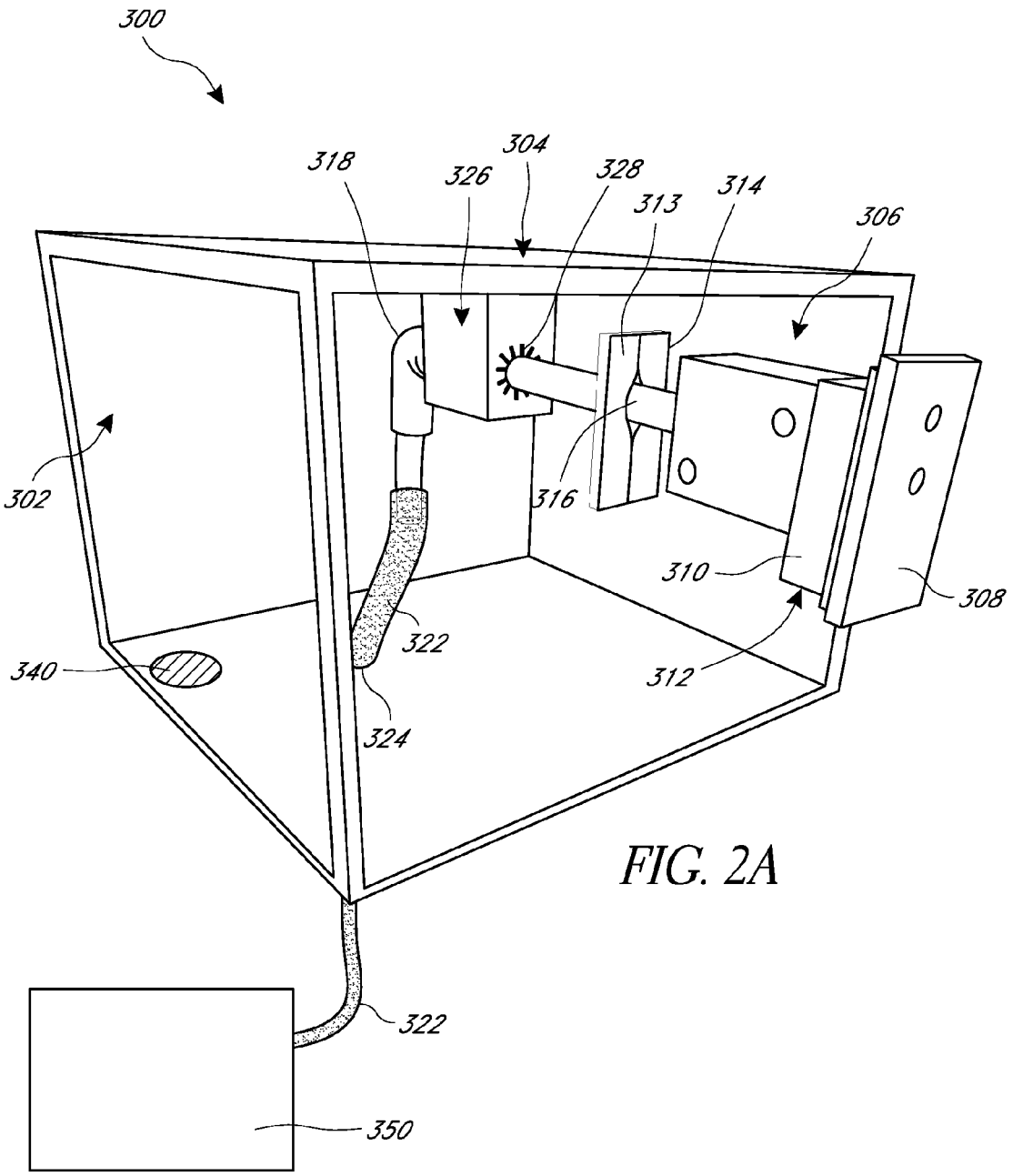
FIG. 2A illustrates a front-perspective view of another embodiment of a beverage dispenser that further includes a secondary seal.
Figure 2B:
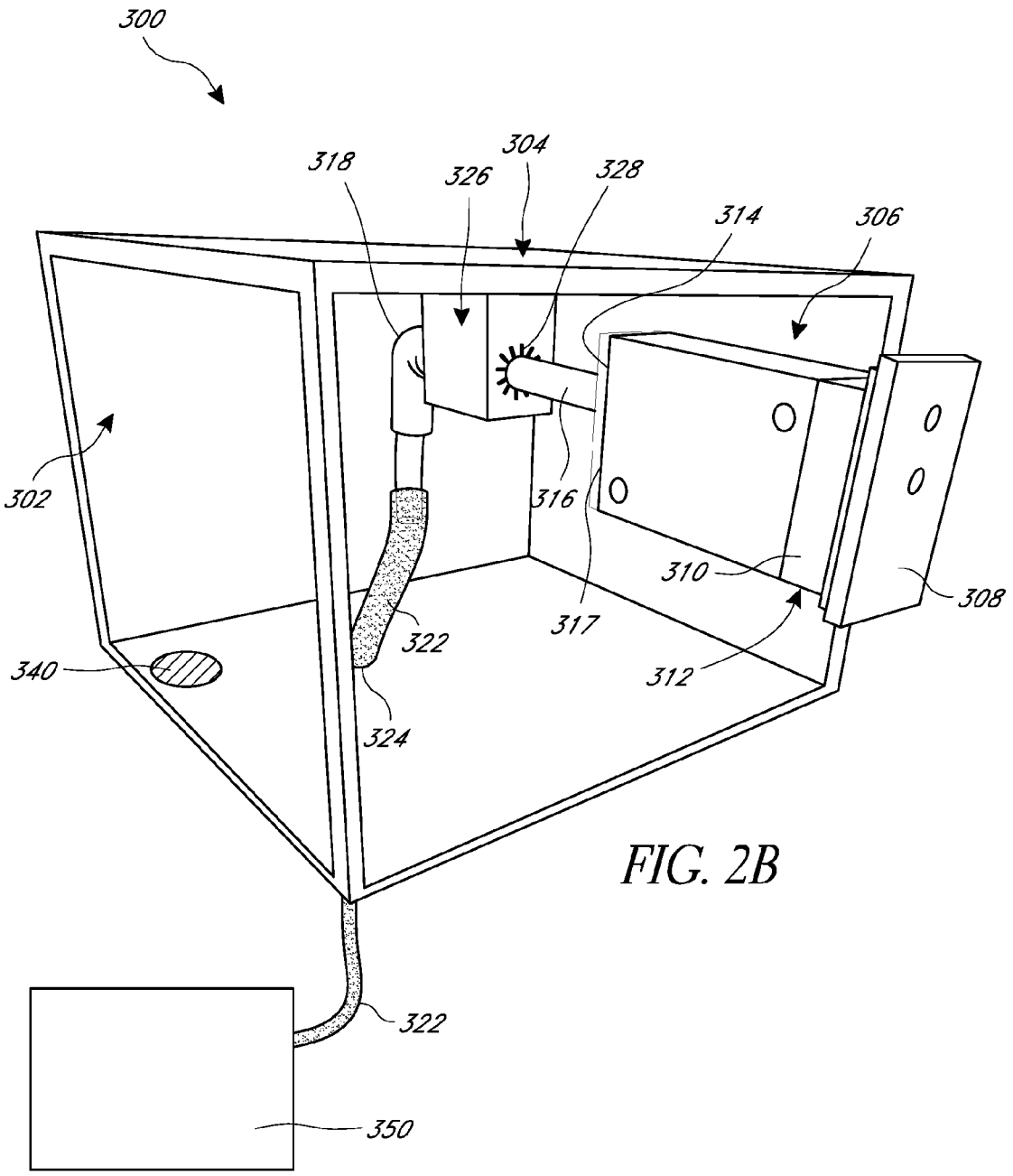
FIG. 2B illustrates a front-perspective view of another embodiment of a beverage dispenser
Figure 2C:
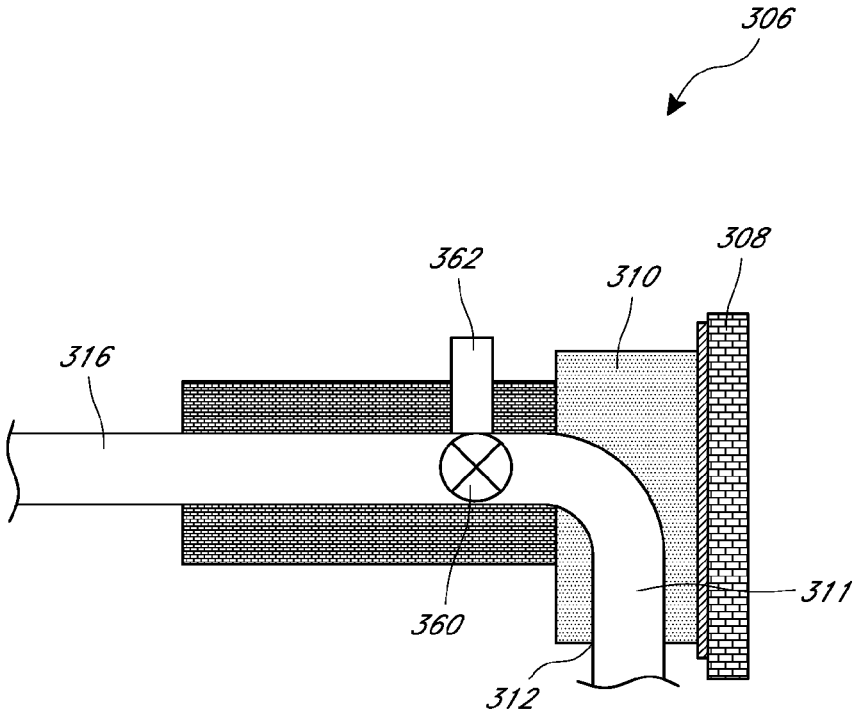
FIG. 2C illustrates a cross-sectional view of an embodiment of a dispenser of FIG. 1.

As shown in FIG. 2C, in the illustrated example embodiment, the dispenser 306 can include a valve 360 and a downwardly protruding dispense tap 311. The valve 360 can move between an open position to place the fluid tube 316 and the dispense tap 311 in fluid communication with each other and a closed position in which the valve 360 prevents fluid from moving from the pipe to the dispense tap 311. As shown in FIG. 2C, the valve 360 can be connected to an actuator 362. In some embodiments, the actuator 362 can be a manual actuator that can be used to manually move the valve between a closed and opened position such as a knob, switch, button, etc. In other embodiments, the actuator 362 can be automatic or semi-automatic in which a knob, switch, button can actuate a motor or other component to move the valve 360 between an opened and closed position. In some embodiments, the actuator 362 can provide for portion control of the beverage dispensed. For example, the actuator 362 can include a mechanism that allows the dispenser 306 to dispense a pre-determined volume of beverage.

As illustrated in FIGS. 1 and 2, in some examples, the dispenser 306 can be configured to extend from and retract into the housing 302. In some embodiments, the dispenser body 306 can include a tap body 310 that can surround the dispense tap 311 described above. As shown in FIG. 2C, the tap body 310 can surround the dispense tap 311 and can include an opening 312 through which the dispense tap 311 can extend. As shown in FIG. 2, the tap body 310 can have dimensions that allow the tap body 310 to be retracted through the opening 314 of the housing 302. In some examples, the tap body 310 can have approximately the same height and width as the opening 314 to provide a seal or close fitting between the opening 314 and the tap body 310 as to prevent or limit the escape of cold air from the housing 302 through the opening 314. In some examples, the tap body 310 can be composed of a stainless steel, plastic, or a material that is NSF compliant. In some embodiments, the tap body 310 can be composed of an insulation material such as foam. In some examples, the tap body 310 can include an insulating material with a hard and durable shell that can be composed of stainless steel, aluminum, copper, brass, plastic, wood, etc. In certain embodiments, the tap body 310 can include a gasket or seal arranged around the perimeter of the tap body 310 that is configured to engage the opening 314 when the dispenser 306 is in the retracted position. In certain embodiments, as illustrated in FIG. 2B, the tap body 310 can have a sufficient length such that in the extended position a perimeter 317 of the tap body 310 can remain in contact with the opening 314 in both the retracted and extended position so as to minimize the loss of cold air from the housing 302 in both the retracted and extended positions. In addition to the tap body 310 or as alternative to an extended top body 310, a rear panel (not illustrated) can be provided on the tap body. The rear panel can be configured to remain in the housing 302 and cover the opening 314 when the tap body 310 is in the extended position so as to prevent or limit the escape of cold air from the housing 302 through the opening 314 when the tap body 310 is in the extended position.

In some embodiments, a front end of the tap body 310 can be coupled or integrally formed with the tab 308. As shown in FIG. 2, in some embodiments, the tab 308 can have dimensions or a shape that does not allow the tab 308 to pass through the opening 314. For example, in the illustrated embodiment, the tab 308 is larger than the opening 314 and covers the opening 314 when the dispenser 306 is in the retracted position so as to close the opening 314 to prevent cold air from escaping from the opening 314. In some examples, as will be discussed in more detail below, the tab 308 can be used as a handle to allow a user to mechanically extend and/or retract the dispenser 306 from and into the housing 302. In some embodiments, the tab 308 can be coupled to the dispenser 306 and the tap body 310 can be eliminated and/or reduced in size such that it does not form a close fit with the opening 314. In other embodiments, the tab 308 can be eliminated and the tap body 310 can provide the seal or close fitting with the opening 314.

As discussed above, in some examples, the dispenser 306 can be coupled to the tube 316. The tube 316 can be configured to provide a fluid connection from the refrigerated beverage in the reservoir 350 through the flexible tube 322 and the angled connector 318. As well, in certain embodiments, the tube 316 can be sufficiently rigid to support the weight of the dispenser 306 allow the dispenser 306 to extend from and retract into the housing 302. In some embodiments, the tube 316 can be composed of stainless steel, aluminum, plastic, or other NSF compliant material.

The material of the tube 316 provides for sanitary food and/or beverage contact. In some embodiments, the tube 316 can withstand exposure to cleaning agents and/or chemicals. In some examples, the thermal properties of the tube 316 can provide for the dissipation of heat so as to allow the beverage within the tube 316 to remain cool. In some embodiments, the tube 316 is composed of a material that can allow the tube 316 to maintain the flexibility and/or rigidity of the tube over the life of the 316. In other embodiments, the tube 316 can be flexible and can fold, bend and/or compress/expand as the dispenser 306 is moved in and out of the retracted and extended position while providing a fluid connection between the reservoir 350 and the dispenser 306. In such examples, the dispenser 306 can be secured on a track (not pictured) that can run along the roof 304 of the housing 302 to support movement of the dispenser 306.

In some embodiments, the beverage dispensing system 300 can include an boss 326 that in the illustrated embodiment can be coupled to the roof 304 of the housing 302 as shown in FIG. 2. In certain embodiments, the boss 326 can be supported by a floor and/or side wall of the housing 302. In some examples, the boss 326 can include as sleeve 328 that extends through the boss 326 such that the tube 316 can be inserted through the sleeve 328. As will be explained below, the sleeve 328 can be configured to allow the tube 316 to slide back and forth within the sleeve 328. As the tube 316 slides back and forth, the flexible tube 322 can bend to allow such movement to occur. In other embodiments, the sleeve 328 can be omitted and the tube 316 can slide within an opening extending through the boss 326. The sleeve 328 can be made of a material that can provide proper support for the tube 316. For example, the material of the sleeve 328 can prevent kinks from forming when the tube moves back and forth. In some embodiments, the material of the sleeve 328 can be configured to allow the tube 316 to slide easily. In some examples, this can allow the tube 316 to be easily replaced by sliding the tube 316 out of the sleeve 328. As noted above, certain embodiments, as illustrated in FIGS. 1-2, the boss 326 can be attached to the roof 304 of the housing 302. In some embodiments, the boss 326 is attached to the housing 302 using a securing mechanism such as (e.g. screws, and/or adhesive). In other embodiments, depending on the location of the opening 314 on the housing 302, the boss 326 can be attached to any surface of the housing 302 (e.g., a floor of the housing 302) or secured by any other structures to allow the fluid tube 316 to extend the dispenser through the opening 314 of the housing 302. In the illustrated embodiment of FIGS. 1 and 2, the dispenser 306 can move along a horizontal and/or substantially horizontal axis as the dispenser moves form the extended to retracted positions.

Figure 2D:
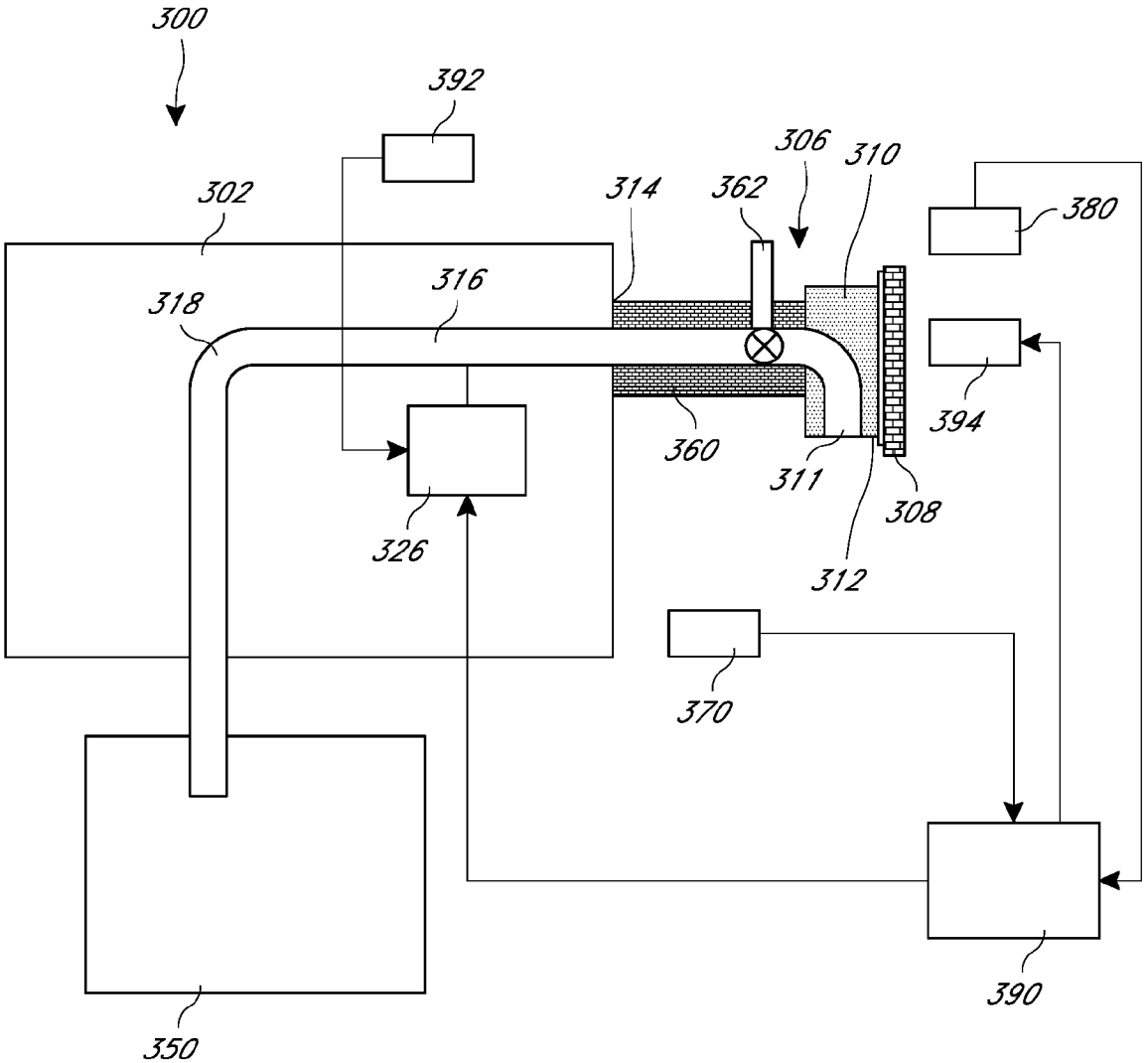
FIG. 2D illustrates a schematic of an embodiment of the beverage dispenser system of FIG. 1.

In some examples, a user can pull the dispenser 306 from the housing 302 by manually pulling on the tab 308 such that the fluid tube 316 moves relative to the boss 326 along a central axis of the sleeve 328. As shown in FIG. 2D, in certain embodiments, the beverage dispensing system 300 can include a mechanism 326 that moves the dispenser 306 between the retracted and extended position. In the illustrated embodiment, the mechanism 326 can include a motor which is coupled to a linkage, which is, in turn, coupled to the pipe 316. The motor accordingly through the linkage can move the pipe 316 back and forth to move the dispenser 306 from the retracted and extended positions. As shown in FIG. 2D, in certain embodiments, the motor 326 can be connected to a user interface 392 (e.g., a button or switch), which can be used to signal the motor 326 to move the dispenser from the retracted or extended position. As shown in FIG. 2D, in certain embodiments, the beverage dispensing system 300 can include a motion sensor 370 that is attached to a control system 390. The control system 390 can send a signal to the motor 326 to extend the tap body 306 from the housing 302 upon receiving an external signal (e.g. hand movement) and subsequently retracting the tap body 306 into the housing 302 upon receiving an external signal (e.g. hand movement). In some embodiments, the control system 390 can receive a voice signal that can send a signal to the motor 326 to extend the tap body 306 from the housing 302 and thereafter retracting the tap body 306 into the housing 302 automatically, or upon receiving a second voice command.

To provide a refrigerated beverage to be dispensed from the dispenser 306, the tube 316 can be fluidly connected to the flexible tube 322, which can be in turn connected to the reservoir 350, which in some embodiments, can be positioned outside the housing 302. In some embodiments, the housing 302 can be large enough to accommodate the beverage reservoir such that the beverage reservoir or portions thereof are positioned within the housing. In some embodiments, the refrigerated beverage can be provided with a pump (not shown) or otherwise kept at a higher pressure such that beverage can be delivered through the flexible tube and fluid tube 316 and out of the opening 312 of the dispenser 306 when the valve 360 is in an open position.

As discussed above, the dispenser 306 can be extended and retracted within the housing 302 of the system for beverage dispensing 300 to ensure that all components of the beverage dispensing system 300 that contact the dispensed beverage remain in the refrigerated environment when the dispenser 306 is in the retracted position. When the dispenser 306 is extended to dispense the beverage, the components of the dispenser 306 and the pipe 316 are preferably provided with sufficient thermal mass such that they remain at a cool temperature and/or close to the refrigerated environment temperature during the dispensing operation even though these components are temporally outside of the refrigerated environment during the dispensing step.

To further ensure that the appropriate temperature is maintained in the dispenser 306 during a dispensing step, in some embodiments as shown in FIG. 2D, the beverage dispensing system 300 can include a sensor 380 that will indicate to the user when the extended dispenser 306 has been out of the housing 302 for a sufficient time such that the dispenser 306 is at a temperature that can cause the beverage within the dispenser 306 to spoil. In other embodiments, the sensor 380 can indicate to the user when the dispenser 306 has been extended out of the housing 302 for a sufficient time such that the housing 302 is expending energy above a certain threshold to maintain the temperature within the housing 302. In certain embodiments, the sensor 380 can comprise one or more temperature sensors within the housing 302 and/or on the dispenser 306 that can be used to indicate when the dispenser 306 and/or space within the housing 302 has exceeded a specified limit. In each of the aforementioned instances, the sensor 380 can either provide an indication (e.g. visual or auditory) until the user retracts the dispenser 306 back into the housing 302 or the dispenser 306 will be automatically retracted into the housing 302. As illustrated in FIG. 2D, the sensor 380 can be connected to a control system 390 and send a signal to the control system 390 when the dispenser 306 has been extended from the housing 302 above a programmed threshold (e.g. temperature or time). The control system 390 can then send a signal to an indicator 394 to provide an indication to the user (e.g. visual or auditory).

In some embodiments, the beverage dispensing system 300 can include a secondary seal or gasket (not illustrated) which can come into contact with the walls of the housing 302 when the tap body 306 is extended from the housing 302 in order to limit the introduction of warm air into the housing 302. In certain embodiments, the seal or gasket can extend around the perimeter of the tab 308 and can contact an exterior surface of the housing 302 when the dispenser 306 is in the closed position. In some embodiments, the secondary seal can be composed of a compliant material, for example rubber, silicone, etc., that can seal the opening 314 when the tap body 306 is extended from the housing 302. In some examples, as illustrated in FIG. 2A, the secondary seal 313 can provide for a small opening to allow the tube 316 and attached tap body 306 to smoothly extend from and retract into the housing 302 while also limiting the warm air allowed into the system for refrigeration.

Figure 3:
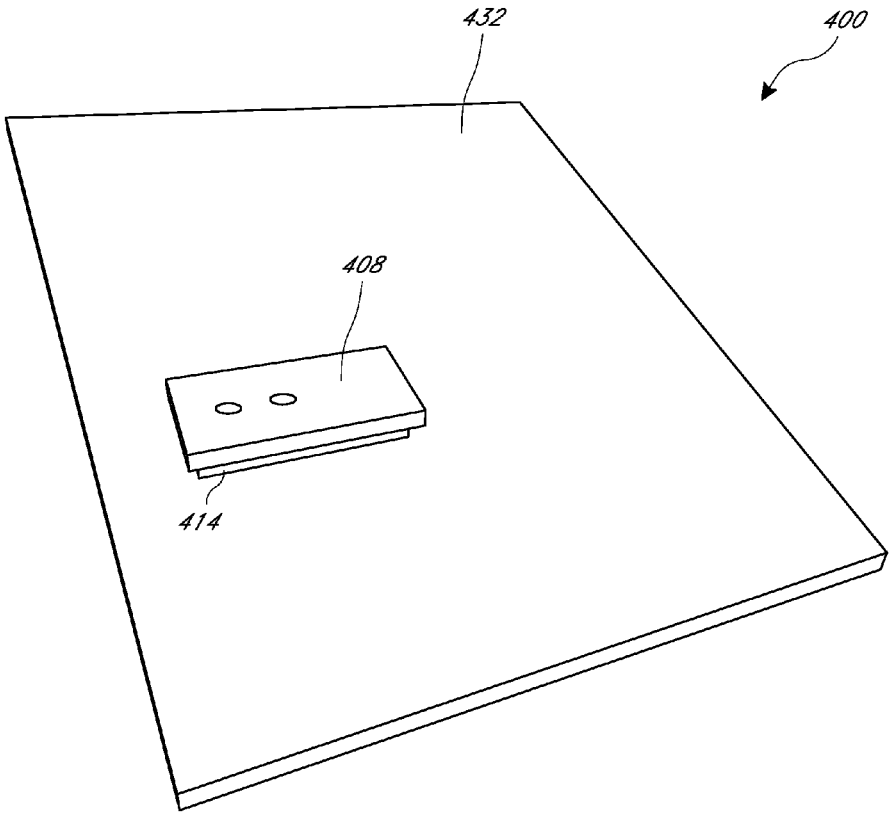
FIG. 3 illustrates is a top perspective view of another embodiment of a beverage dispensing system with a tap shown retracted within the beverage dispenser system.
Figure 4:
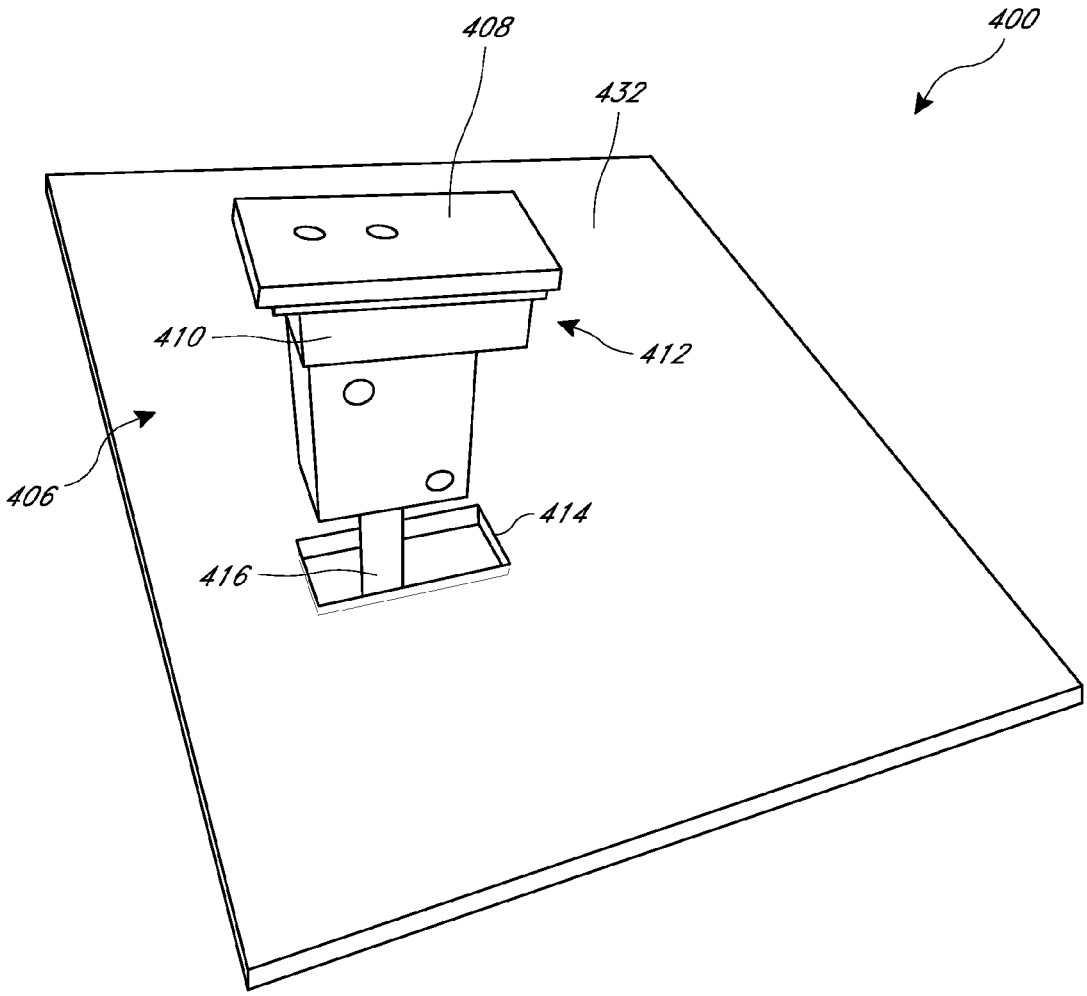
FIG. 4 illustrates a top-perspective view of the dispenser system of FIG. 3 with the tap in an extended position.

In certain embodiments, the system for beverage dispensing 300 can provide an indication to the user when possible spoiling of the beverage has occurred to allow the user the opportunity to clean or replace parts of the system for beverage dispensing 300. In some embodiments, the system for beverage dispensing 300 can communicate to the user when the beverage stored within the system for beverage dispensing 300 has spoiled and/or when the beverage stored has exceeded a minimum temperature for a specified amount of time In certain embodiments, to reduce the space taken up by the housing, the beverage dispenser system can be located below a surface, such as a table 432. FIGS. 3-4 illustrate an example beverage dispensing system 400 wherein the dispenser 406 extends through an opening 414 in the surface of the table 432. In some embodiments a system for refrigeration is located below the surface of the table 432 and maintains all components of the system for beverage dispensing 400 within a desired temperature range, which in certain embodiments can be a temperature of between 35° F. and about 40° F. which is suitable for milk. The temperature range can be modified depending upon the beverage being stored and dispensed. In some embodiments, the system for refrigeration maintains all components of the system for beverage dispensing 400 at a temperature that allows the beverage to be served chilled—for example an iced beverage, such that the beverage can be served with ice without causing the ice to melt quickly. As will be explained below, in the embodiment of FIGS. 3 and 4, the dispenser 406 can move along a vertical or substantially vertical axis as the dispenser moves from the extended to retracted positions.

As with the housing 302 for the beverage dispensing system 300 of FIGS. 1-2D, in some embodiments, the beverage dispensing system 400 can include an opening 414 that allows certain internal components of the system for beverage dispensing 400 to extend from the table 432 and dispense the beverage. As will be discussed in more detail below, the dispenser 406, like the dispenser 306 of the system for beverage dispensing 300 can include a tab 408 that prevents or inhibits cold air from escaping the table 432 when the internal components of the system for beverage dispensing 400 are retracted. Many of the components of the beverage dispensing system 400 of FIGS. 3-4 can be similar and/or the same as the dispensing system 300 of FIGS. 1-2 and thus have been given similar names and numbers with the numbers of FIGS. 3-4 being preceded by "4" instead of "3." Accordingly, for similar components reference can also be made to the description above with specific possible variations being highlighted below. It should also be appreciated that certain components of the systems of 300 and 400 can be combined and/or substituted with each other in certain embodiments. For simplicity, certain components of the beverage dispensing system 400 are not illustrated in FIGS. 3 and 4 such as the components within the housing beneath the table 432 such a boss, sleeve, an angled connector, a flexible tube and the components of FIGS. 2C and 2D. As noted above, a description of such components which can be used with the embodiments of FIGS. 3 and 4 can be found in the description above with reference to FIGS. 1-2D.

With reference to FIGS. 3 and 4, not unlike the beverage dispensing system 300, in some examples, the internal components of the system for beverage dispensing 400, the dispenser 406 is configured to extend from the table 432 to dispense a beverage. In some embodiments, the dispenser 406 can be fluidly connected to a refrigerated beverage reservoir (not shown) through a one or more of channels, tubes, pipes etc. and in certain embodiments a configuration similar to the configuration of FIGS. 1 and 2 can be used. As illustrated in FIGS. 3-4, in some examples, the dispenser 406 is fluidly connected to the refrigerated beverage through a rigid fluid tube 416.

As discussed above, in some embodiments, the beverage dispensing system 400 can include the retractable dispenser 406. As illustrated in FIGS. 3 and 4, in some examples, the beverage dispensing system 400 can include the dispenser 406 that is configured to extend from and retract into the table 432. In certain embodiments, the table 432 includes a refrigeration system below the surface of the table 432 that maintains all components that come in contact with a beverage from the beverage dispensing system 400 at a low temperature. As discussed above, the "refrigeration system" includes is a broad term that in addition to its ordinary meaning includes a cooled environment in light of sanitary and/or regulatory concerns of the dispensed beverage. In certain embodiments, the refrigerated environment can be maintained at a temperature of between 35° F. and about 40° F. and/or a different temperature range depending upon the beverage and/or desired dispensing temperature. In some examples, the table 432 can be composed of a structural and/or insulation materials such as various combinations, of plastics, metals, foams, fiberglass, polyurethane insulation, air gaps, etc. so as to provide sufficient insulation to maintain the cooling temperature within the table 432.

The dispenser 406, like the dispenser 306 illustrated in FIG. 2C, can include a valve 460 and a downwardly protruding dispense tap. As discussed above with regard to the valve 360, the valve can move between an open position to place the fluid tube 416 and dispense tap in fluid communication with each other and a closed position in which the valve prevents fluid from moving from the pipe to the dispense tap. Like the dispenser 306 illustrated in FIG. 2C the valve can be connected to an actuator. In some embodiments, the actuator can be a manual actuator that can be used to manually move the valve between a closed and open position using an actuator such as a knob, switch, button, etc. In other embodiments, the actuator can be automatic or semi-automatic in which the knob, switch, button can actuate a motor or other component to move the valve between an opened and closed position.

In some embodiments, the dispenser 406 can include a tap body 410 that can surround the dispense tap 411 described above. In some examples, the tap body 410 can surround the dispense tap 411 and can include an opening 412 through which the dispense tap 411 can extend. As shown in FIG. 3, the tap body 410 can have dimensions that allow the tap body 410 to be retracted through the opening 414 of the table 432. In some examples, the tap body 410 can have approximately the same height and width as the opening 414 to provide a seal or close fitting between the opening 314 and the tap body 410 so as to prevent or limit the escape of cold air from the table 432 through the opening 414. In some embodiments, the tap body 410 can be composed of foam. In some examples, the tap body 310 can include an insulating material with a hard and durable shell that can be composed of stainless steel, aluminum, copper, brass, plastic, wood, etc. In certain embodiments, the tap body 410 can include a gasket or seal arranged around the perimeter of the tap body 410 that is configured to engage the opening 414 when the dispenser 406 is in the retracted position. In certain embodiments, like the tap body 410 illustrated in FIG. 2B, the tap body 410 can have a sufficient length such that in the extended position a perimeter of the tap body 410 can remain in contact with the opening 414 in both the retracted and extended position so as to minimize the loss of cold air from the table 432 in both the retracted and extended positions.

In some embodiments, the tap body 410 can include a tab 408 attached at the front end of the tap body 410. As shown in FIG. 3, in some embodiments, the tab 408 can have dimensions or a shape that does not allow the tab 408 to pass through the opening 414. For example, in the illustrated embodiment, the tab 408 is larger than the opening 414 and covers the opening 414 when the dispenser 406 is in the retracted position so as to close the opening 414 and prevent cold air from escaping from the opening 414. In some embodiments, this can prevent the tap body 406 from retracting too far into the table 432. In some examples, as will be discussed in more detail below, the tab 408 can be used as a handle to allow a user to mechanically extend and/or retract the dispenser 406 from and into the table 432. In some embodiments, the tab 408 can be coupled to the dispenser 406 and the tap body 410 can be eliminated and/or reduced in size such that it does not form a close fit with the opening 414. In other embodiments the tab 408 can be eliminated and the dispenser 406 can provide the seal or close fitting with the opening 414.

As discussed above, in some examples, the tap body 406 can be coupled to the tube 416. The tube 416 can be configured to provide a fluid connection from the refrigerated beverage in the reservoir to the dispenser 406. As well, in some embodiments, the tube 416 can be sufficiently rigid to allow the dispenser 406 to extend from and retract into the table 432. In some embodiments, the tube 416 can be composed of plastic, or other NSF compliant material. The material of the tube 416 can provide for sanitary food and/or beverage contact. In some embodiments, the tube 316 can withstand exposure to cleaning agents and/or chemicals. In some examples, the thermal properties of the tube 316 should provide for the dissipation of heat so as to allow the beverage within the tube 316 to remain cool. In some embodiments, the tube 316 is composed of a material that can allow the tube 316 to maintain the flexibility and/or rigidity of the tube over the life of the 316. In other embodiments, the fluid tube 416 can be flexible and be configured to provide a fluid connection between the reservoir 450 and the dispenser 406. In such examples, the dispenser 406 can be secured to a track or a separate structure that can allow the dispenser 406 to be extended and retracted from the table 432.

In some embodiments, the beverage dispensing system 400 can include a boss (not illustrated) similar to the boss of FIGS. 1 and 2 that can be configured to extend and retract the tap body 406 from the table 432. In some examples, the mechanism can retain the tube 416 so as to support the tube 416 as it extends out from the table 432. For example, the boss can be coupled to a portion of the table 432. In some embodiments, the mechanism can include a sleeve that extends through the boss such that the tube 416 can be inserted through the sleeve. In some embodiments, the sleeve can be configured to allow the tube 316 to slide back and forth within the sleeve.

In some examples, a user can pull the dispenser 406 from the table 432 by manually lifting the dispenser 406 from the opening 414 using the tab 408. In certain embodiments, the beverage dispensing system 400 can include a mechanism for automatically moving the dispenser 406 between the retracted and extended position such as the mechanism described with reference to FIG. 2D. In some embodiments, the mechanism can include a motor which is coupled to a linkage, which is, in turn, coupled to the fluid tube 416. The motor accordingly through the linkage can move the tube 416 back and forth to move the dispenser 406 from the retracted and extended positions. Like the beverage dispensing system 300 illustrated in FIG. 2D, the beverage dispensing system 400 can include a motor (e.g. motor 326) connected to a user interface (e.g. user interface 392) that can be, for example, a button or a switch. The user interface can be used to signal the motor to move the dispenser 406 from the retracted or extended positions.

In some embodiments, the mechanism (not illustrated) supporting the tube 416 can include a ratchet that locks the dispenser 406 in an extended position when it is manually pulled out. The mechanism can be subsequently released by pulling up or pushing down on the dispenser 406 to allow the dispenser 406 to retract into the opening 414 of the table 432.

Like the embodiment shown in FIG. 2D, in some embodiments, the beverage dispensing system 400 can include a motion sensor (e.g. motion sensor 370) that is attached to a control system (e.g. control system 390). The control system can send a signal to the motor to extend the tap body 406 from the table 432 upon receiving an external signal (e.g. a hand movement) and subsequently retracting the tap body 406 into the table 432 upon receiving an external signal (e.g. a hand movement). In some embodiments, the control system 390 can receive a voice signal that can send a signal to the motor 326 to extend the tap body 306 from the housing 302 and thereafter retracting the tap body 306 into the housing 302 automatically, or upon receiving a second voice command.

To provide a refrigerated beverage to be dispensed from the dispenser 406, the fluid tube 416 can be fluidly connected to the reservoir. In some embodiments, the reservoir can be positioned in the refrigerated system underneath the table 432, or in a separate location. In some embodiments, the reservoir can be provided with a pump or otherwise kept at a higher pressure such that beverage can be delivered through the fluid tube 416 and out of the opening 412 of the dispenser 406 when the valve 360 is in an open position.

As with the system for beverage dispensing 300, the dispenser 406 can be extended and retracted under the table 432 of the beverage dispensing system 400 to ensure that all or substantially all components of the beverage dispensing system 400 that come in contact with the beverage remain in the refrigerated environment when the dispenser 406 is in the retracted position. When the dispenser 406 is extended to dispense the beverage, the components of the dispenser 406 and the pipe 416 are preferably provided with sufficient thermal mass such that they remain at a cool temperature and/or close to the refrigerated environment temperature during the dispensing operation even though these components are temporally outside of the refrigerated environment during the dispensing step.

To further ensure or facilitate that the appropriate temperature is maintained in the dispenser 406, in some embodiments, the beverage dispensing system 400 can include various sensors as illustrated in FIG. 2D for the beverage dispensing system 300. For example, in some embodiments, the beverage dispensing system 400 can include a sensor (e.g. sensor 380) that will indicate to the user when the extended dispenser 406 (e.g. FIG. 4) has been out of the table 432 for a sufficient time such that the dispenser 406 is at a temperature that can cause beverage within the dispenser 406 to spoil. In other embodiments, the sensor (e.g. sensor 380) can indicate to the user when the dispenser 406 has been extended out of the table 432 for a sufficient time such that the refrigeration system is expending energy above a certain threshold to maintain the temperature within the refrigeration system. In certain embodiments, the sensor can comprise one or more temperature sensors underneath the table 432 and/or on the dispenser 406 that can be used to indicate when the dispenser 406 and or space underneath the table 432 has exceeded a specified limit. In each of the aforementioned instances, the sensor can either provide an indication (e.g. visual or auditory) until the user retracts the dispenser 406 back into the table 432 or the tap body 406 will be automatically retracted into the table 432. As illustrated in FIG. 2D for beverage dispensing system 300, the beverage dispensing system 400 can also include a sensor (e.g. sensor 380) that can be connected to a control system (e.g. control system 390). The sensor (e.g. sensor 380) can be configured to send a signal to the control system (e.g. control system 390) when the dispenser 406 has been extended from the table 432 above a programmed threshold. The control system (e.g. control system 390) can then send a signal to an indicator (e.g. indicator 394) to provide an indication to the user (e.g. visual or auditory).

In certain embodiments, the system for beverage dispensing 400 can include a secondary seal (not illustrated) which can seal the opening 414 when the tap body 406 is extended from the table 432 in order to limit the introduction of warm air into the refrigeration below the surface of the table 432 in a manner similar to the embodiment shown in FIG. 2A. In some embodiments, the secondary seal can be composed of a compliant material, for example rubber, silicone, etc., that can seal the opening 414 when the tap body 406 is extended from the table 432. In some examples, the secondary seal can provide for a small opening to allow the pipe 416 and attached tap body 406 to smoothly extend from and retract into the table 432 while also limiting the warm air allowed into the system for refrigeration. Similar to the embodiment shown in FIG. 2B, in certain embodiments, the tap body 410 can have a sufficient length such that in the extended position a perimeter 3 of the tap body 410 can remain in contact with the opening 414 in both the retracted and extended position so as to minimize the loss of cold air from the housing in both the retracted and extended positions. In addition to the tap body 410 or as alternative to an extended top body 410, a rear panel (not illustrated) can be provided on the tap body 410. The rear panel can be configured to remain in within housing and the cover the opening 414 when the tap body 310 is in the extended position so as to prevent or limit the escape of cold air from the housing 302 through the opening 314 when the tap body 310 is in the extended position.

In certain embodiments, the system for beverage dispensing 400 can provide an indication to the user when possible spoiling of the beverage has occurred to allow the user the opportunity to clean or replace parts of the system for beverage dispensing 400. In some embodiments, the system for beverage dispensing 400 can communicate to the user when the beverage stored within the system for beverage dispensing 400 has spoiled.

Doored Beverage Dispenser System

Figure 5:
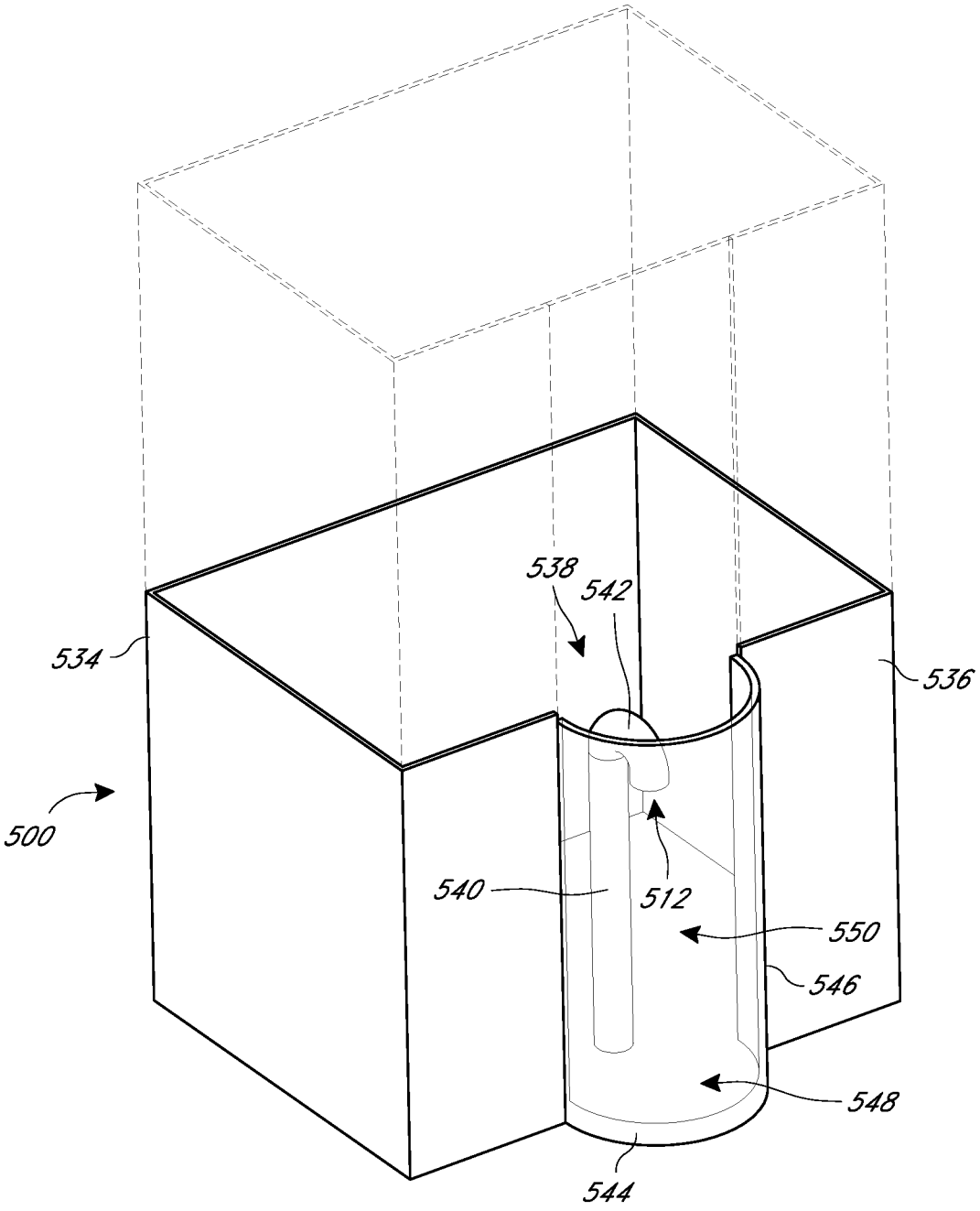
FIG. 5 illustrates a front-perspective view a doored beverage dispenser system in a closed position.
Figure 6:
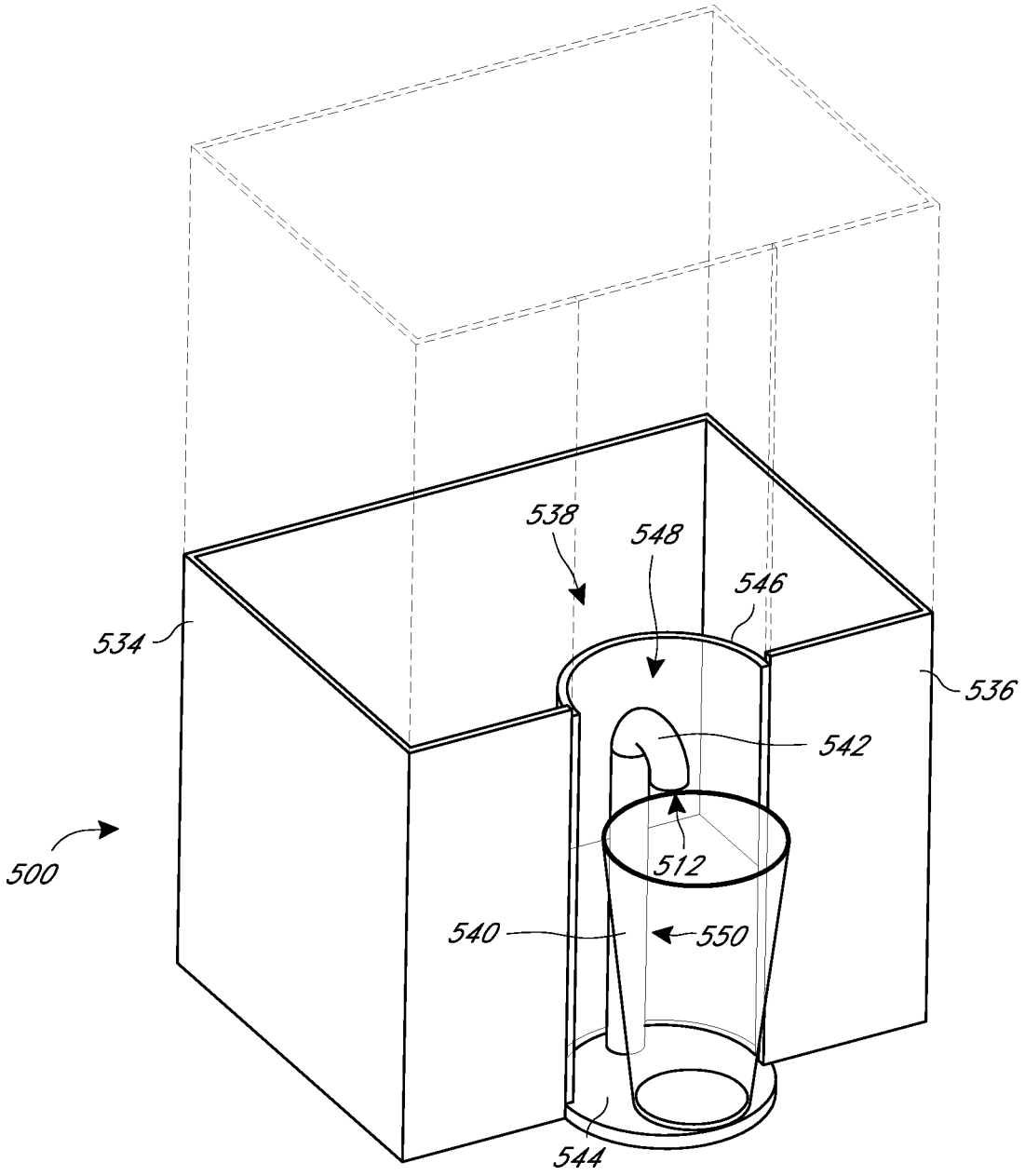
FIG. 6 illustrates a front-perspective view of the doored beverage dispenser system of FIG. 5 where the door is in an open position.
Figure 7:
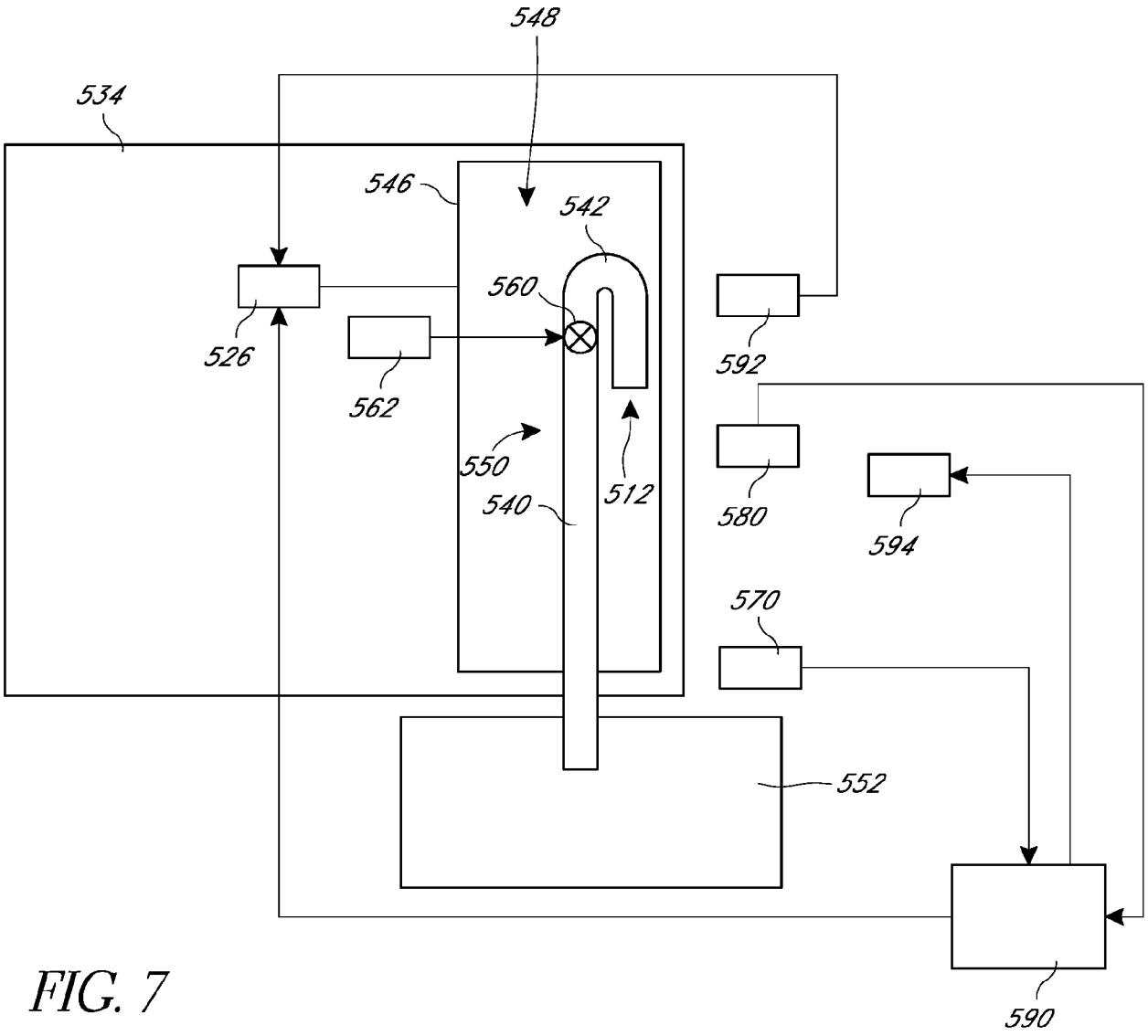
FIG. 7 illustrates a schematic of an embodiment of the beverage dispenser system of FIG. 5.

FIGS. 5-6 illustrate an embodiment of a beverage dispensing system 500 in which a dispenser 550 can be built or added onto the side of a refrigeration unit. FIG. 5 illustrates the dispenser 550 positioned behind a closed door 546. FIG. 6 illustrates the beverage dispensing system 500 with the door 546 rotated back to an open position to allow the dispensing of a beverage into a receptacle. In FIGS. 5 and 7 a top wall or roof of the beverage dispensing system 500 is not shown so that the internal components can be viewed.

As discussed, in some embodiments, the beverage dispensing system 500 is in thermal or fluid communication with housing 534, which can form an enclosed space 548 that can be cooled. FIGS. 5 and 7 a top wall or roof of the housing 534 is not shown so that the internal components can be viewed.

In the illustrated example, the housing 534 can include an opening 538 in a front wall 536 of the housing 534 to accommodate a platform 544 and a door 546. In some embodiments, the door 546 can be curved and form a seal or barrier about a curve of the platform. The platform 544 and door 546 can be any size or shape and preferably as a seal is formed between the door 546 and the platform 544. In some embodiments, a bottom end of the door 646 can be positioned within a groove formed in the platform 544. The groove can guide sliding movement of the door 546 and aid in forming a seal or barrier to the escape of cold air from the housing 534. In some examples, the door 546 and the platform 544 can provide a seal or barrier such that the temperature can be maintained within the housing 534 and heat transfer through the door and platform in the cold position is reduced.

As illustrated in FIGS. 5-7, the dispenser 550 can be composed of a fluid tube 540 that extends from the platform 544. In some embodiments, the base of the fluid tube 540 of the dispenser 550 can be fluidly connected to a refrigerated beverage contained within a reservoir 552. As illustrated, in some embodiments, the dispenser 550 can include a curved portion 542 that curves the fluid tube 540 downward such that the beverage can be dispensed from an opening 512. In some embodiments, the refrigerated beverage reservoir can be provided with a pump (not shown) or maintained at a higher pressure such that the beverage can be delivered through the fluid tube 540 of the dispenser 550 and out of the opening 512 of the dispenser 550. To dispense beverage, the dispenser 550 can be configured for manual control by the operator and/or automatic control. For example, in certain embodiments, the user can pull a lever or button (not shown) down for as long as they want the beverage to dispense. In certain embodiments, the apparatus can be provided with flow meter and a digital or analog display of how much liquid has been dispensed. In certain embodiments, the dispenser 550 can be configured for automatic control wherein a user can inputting the type and/or size of drink to be dispensed. The dispenser 550 can then use a flow meter, a timer or a scale to know how much of the beverage has been dispensed and appropriately shut off a dispense valve when the appropriate amount of beverage has been delivered.

As shown in FIG. 7, in the illustrated example embodiment, the dispenser 550 can include a valve 560. The valve 560 can be connected to an actuator 562. In some embodiments, the actuator 562 can be a manual actuator that can be used to manually move the valve between a closed and opened position such as a knob, switch, button, etc. In other embodiments, the actuator 562 can be automatic or semi-automatic in which a knob, switch, button can actuate a motor or other component to move the valve 560 between an opened and closed position.

As shown in FIGS. 5-6, in some embodiments, the door 546 can be actuated to expose the dispenser 550. In some embodiments, the platform 544 provides a surface for which a receptacle (e.g. a cup) is placed. Once the beverage has been dispensed, the door 546 can be actuated to return to its unopened position and return the dispenser 550 to its refrigerated environment. In some embodiments, the door 546 can be actuated by the user to open and close the door 546 to provide access to the dispenser 550. As shown in FIG. 7, in certain embodiments, the beverage dispensing system 500 can include an actuator 526 that allows the door 546 to move between the opened and closed position. In the illustrated embodiment, the actuator 526 can include a motor which is coupled to a linkage, which is, in turn coupled to the door 546. The motor accordingly through the linkage can move the door 546 between the opened and closed positions. As shown in FIG. 7, the actuator 526 can be connected to a user interface 592 (e.g., a button or switch), which can be used to signal the actuator 526 to move the door 546 from the opened or closed position.

As shown in FIG. 7, in some embodiments, the beverage dispensing system 500 can include a motion sensor 570 that is attached to a control system 390. The control system 390 can send a signal to the actuator 526 to actuate the door 546 upon receiving an external signal (e.g. hand movement) is detected.

As discussed above, the door 546 can be opened and closed within the housing 534 of the beverage dispensing system 500 to ensure that all components of the beverage dispensing system 500 that contact the dispensed beverage remain in the refrigerated environment when the dispenser 550 is retained within the enclosed space 548 of the housing 534. When the door 546 is opened to allow the dispenser 550 to dispense the beverage, the components of the dispenser 550 and fluid tube 540 are preferably provided with sufficient thermal mass such that they remain at a cool temperature and/or close to the refrigerated environment temperature during the dispensing operation even though these components are temporally outside of the housing 534 during the dispensing step. In some examples, the door 546 can provide a seal or barrier such that the temperature can be maintained within the housing 534 and heat transfer through the door is reduced even when the door 546 is opened to allow access to the fluid tube 540.

As discussed with regard to the beverage dispensing system 300 and the beverage dispensing system 400, to further ensure that the appropriate temperature is maintained in the beverage dispensing system 500, in some embodiments, the beverage dispensing system 500 can include a sensor 580 that can indicate to the user when the dispenser 550 has been exposed for a sufficient time (e.g. with the door 546 opened) such that the dispenser 550 is at a temperature that can cause the beverage within the dispenser 550 to spoil. In some embodiments, the sensor 580 can indicate to the user when the door 546 has been opened for a sufficient time such that the housing 534 is expending energy above a certain threshold in order to maintain the temperature within the housing 534. In certain embodiments, the sensor 580 can comprise one or more temperature sensors within the housing 534 and/or on the dispenser 550 that can be used to indicate when the dispenser 550 and/or enclosed space 548 has exceeded a specified limit. In each of the aforementioned instances, the sensor 580 can either provide an indication (e.g. visual or auditory) until the user closes the door 546 or the door 546 automatically closes. As illustrated in FIG. 7, the sensor 580 can be connected to a control system 590 and send a signal to the control system 590 when the housing 534 has been opened above a programmed threshold (e.g. temperature or time). The control system 590 can then send a signal to an indicator 594 to provide an indication to the user (e.g. visual or auditory).

In some embodiments, the system for beverage dispensing 500 can include a secondary seal (not illustrated) which can close off the bulk of the housing 534 when the door 546 is opened to allow access to the dispenser 550. In some examples this can limit the introduction of warm air into the bulk of the housing 534. In some embodiments, the secondary seal can be composed of a compliant material, for example rubber, silicone, etc., that can seal the housing 534 when the door 546 is opened.

In some embodiments, the system for beverage dispensing 500 can provide an indication to the user when possible spoiling of the beverage has occurred so as to allow the user the opportunity to clean or replace parts of the system for beverage dispensing 500. In some embodiments, the system for beverage dispensing 500 can communicate to the user when the beverage stored within the system for beverage dispensing 500 has spoiled.

Certain Terminology

As used herein, the term "beverage" has its ordinary and customary meaning, and includes, among other things, any edible liquid or substantially liquid substance or product having a flowing quality (e.g., milk, dairy products, juices, coffee beverages, teas, frozen yogurt, beer, wine, cocktails, liqueurs, spirits, cider, soft drinks, flavored water, energy drinks, soups, broths, combinations of the same, or the like).

Although certain embodiments have been described herein with respect to milk, the beverage dispensers described herein can be used for any other beverages that can potentially spoil. For example, this can include any beverages such as liquids containing dairy products, juices, coffee beverages, teas, frozen yogurt, beer, wine, cocktails, liqueurs, spirits, cider, soft drinks, flavored water, energy drinks, soups, broths, combinations of the same, or the like Conditional language, for example, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Although certain embodiments and examples have been described herein, it will be understood by those skilled in the art that many aspects of the methods and devices shown and described in the present disclosure may be differently combined and/or modified to form still further embodiments or acceptable examples. All such modifications and variations are intended to be included herein within the scope of this disclosure. A wide variety of designs and approaches are possible. No feature, structure, or step disclosed herein is essential or indispensable.

Some embodiments have been described in connection with the accompanying drawings. However, it should be understood that the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount or equal to or greater than 10% of the stated amount. The term "generally" as used herein represents a value, amount, or characteristic that predominantly includes or tends toward a particular value, amount, or characteristic. The ranges disclosed herein also encompass any and all overlap, sub-ranges, and combinations thereof. Language such as "up to," "at least," "greater than," "less than," "between," and the like include the number recited. Numbers preceded by a term such as "about" or "approximately" include the recited numbers and should be interpreted based on the circumstances (e.g., as accurate as reasonably possible under the circumstances, for example. For example, "about 1 gram" includes "1 gram."

Summary

Although this disclosure describes certain embodiments and examples of beverage dispensing systems, many aspects of the methods and devices shown and described in the present disclosure may be combined differently and/or modified to form still further embodiments or acceptable examples. All such modifications and variations are intended to be included herein within the scope of this disclosure. Indeed, a wide variety of designs and approaches are possible and are within the scope of this disclosure. For example, although some embodiments have been disclosed that are directed specifically to milk, the use of the beverage dispensers for other types of beverages is contemplated as well. While illustrative embodiments have been described herein, the scope of any and all embodiments having equivalent elements, modifications, omissions, combinations (e.g., of aspects across various embodiments), adaptations and/or alterations as would be appreciated by those in the art based on the present disclosure.

Also, although there may be some embodiments within the scope of this disclosure that are not expressly recited above or elsewhere herein, this disclosure contemplates and includes all embodiments within the scope of what this disclosure shows and describes. Further, this disclosure contemplates and includes embodiments comprising any combination of any structure, material, step, or other feature disclosed anywhere herein with any other structure, material, step, or other feature disclosed anywhere herein.

Furthermore, certain features that are described in this disclosure in the context of separate implementations, arrangements and/or embodiments can also be implemented in combination in a single implementation arrangements and/or embodiments. Conversely, various features that are described in the context of a single implementation arrangements and/or embodiments can also be implemented in multiple implementations arrangements and/or embodiments separately or in any suitable subcombination. Moreover, although features may be described above as acting in certain combinations, one or more features from a claimed combination can, in some cases, be excised from the combination, and the combination may be claimed as a subcombination or variation of a subcombination.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Some embodiments have been described in connection with the accompanying drawings. However, the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Also, any methods described herein may be practiced using any device suitable for performing the recited steps.

Moreover, while components and operations may be depicted in the drawings or described in the specification in a particular arrangement or order, such components and operations need not be arranged and performed in the particular arrangement and order shown, nor in sequential order, nor include all of the components and operations, to achieve desirable results. Other components and operations that are not depicted or described can be incorporated in the embodiments and examples. For example, one or more additional operations can be performed before, after, simultaneously, or between any of the described operations. Further, the operations may be rearranged or reordered in other implementations. Also, the separation of various system components in the implementations described above should not be understood as requiring such separation in all implementations, and it should be understood that the described components and systems can generally be integrated together in a single product or packaged into multiple products.

In summary, various illustrative embodiments and examples of beverage preparations systems, components, and related methods have been disclosed. Although the systems have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow as well as their full scope of equivalents.

What is claimed is:

1. A system for dispensing a chilled beverage, the system comprising:

a housing having an opening, wherein the housing is configured to maintain a low temperature within the housing;

a dispense tap having an opening for dispensing the chilled beverage, the dispense tap being configured to move between a retracted position in which the dispense tap is positioned within the housing and an extended position in which the dispense tap extends out through the opening to a position outside the housing; and a sensor and control system configured to provide an indication to a user when the dispense tap has been extended out from the housing for a certain amount of time.

2. The system of claim 1, comprising a tap body coupled to the dispense tap, the tap body configured to close the opening when the dispense tap is in the retracted position.

3. The system of claim 2, wherein the tap body is coupled to a tab, the tab being larger than the opening and configured to cover the opening when the dispense tap is in the retracted position.

4. The system of claim 2, wherein the tap body has a length configured to cover or close the opening when the dispense tap is in the extended position.

5. The system of claim 1, comprising a tab coupled to the dispense tap, the tab being larger than the opening and configured to cover the opening when the dispense tap is in the retracted position.

6. The system of claim 1, wherein the dispense tap is coupled to a pipe.

7. The system of claim 1, wherein a pipe extends through a boss supported within the housing and the pipe is configured to slideably move within the boss as the dispense tap moves between the extended and retracted positions.

8. The system of claim 7, wherein the boss is coupled to a roof of the housing.

9. The system of claim 7, wherein the pipe is coupled to a motor for moving the dispense tap between the extended and retracted positions.

10. The system of claim 1, further including a temperature sensor and a control system configured provide an indication to a user when a temperature within the dispense tap exceeds a threshold value.

11. The system of claim 1, wherein the dispense tap moves in along a substantially horizontal axis as the dispense tap moves between the retracted and extended positions.

12. The system of claim 1, wherein the dispense tap moves in along a substantially vertical axis as the dispense tap moves between the retracted and extended positions.

13. The system of claim 1, comprising a seal coupled to the opening of the housing, the seal configured to allow the dispense tap to extend through the opening while also covering the opening when the dispense tap is in the extended position.

14. A system for dispensing a chilled beverage, the system comprising:

a housing having an opening, wherein the housing is configured to maintain a low temperature within the housing;

a dispense tap having an opening for dispensing the chilled beverage, the dispense tap being configured to move between a retracted position in which the dispense tap is positioned within the housing and an extended position in which the dispense tap extends out through the opening to a position outside the housing;

wherein a pipe extends through a boss supported within the housing and the pipe is configured to slideably move within the boss as the dispense tap moves between the extended and retracted positions and wherein the pipe is coupled to a motor for moving the dispense tap between the extended and retracted positions a motion sensor that is configured to actuate the motor to extend or retract the dispense tap between the extended and retracted positions.

15. The system of claim 14, further including a sensor and control system configured to provide an indication to a user when the dispense tap has been extended out from the housing for a certain amount of time.

16. The system of claim 14, comprising a tap body coupled to the dispense tap, the tap body configured to close the opening when the dispense tap is in the retracted position.

17. A system for dispensing a chilled beverage, the system comprising:

a housing forming an enclosure, wherein the housing is configured to maintain the enclosure at a low temperature, the housing including an opening;

a door forming a compartment that is connected to the opening in the enclosure; and a beverage dispenser located within the compartment;

wherein the door moves between an closed position in which the beverage dispenser is positioned behind the door and an open position where the door is positioned behind the beverage dispenser and the door closes the opening in the the enclosure.

18. The system of claim 17 wherein the door is curved and moves along a curved path between the closed and open positions.

19. The system of claim 17, further including a motion sensor that is configured to actuate the door to provide access to the beverage dispenser.

20. The system of claim 17 further including a temperature sensor configured to provide an indication to a user when the temperature within the compartment exceeds a certain threshold.

21. The system of claim 17, wherein the system includes a seal that is configured to limit the introduction of warm air into the refrigeration system when the door is opened.

22. The system of claim 17, wherein the compartment extends from the housing.

* * * * *